United States Patent [19]

Mirabella, Jr. et al.

[11] Patent Number: 4,864,124

[45] Date of Patent: Sep. 5, 1989

[54] SEALED MECHANICAL ACTUATOR AND ELECTRO-OPTIC SENSOR FOR USE IN SHEET FEEDING

[75] Inventors: Charles J. Mirabella, Jr.; Brian D. Marsden; Russell McDonald, all of Rochester, N.Y.

[73] Assignee: Xerox Corporation, Stamford, Conn.

[21] Appl. No.: 146,539

[22] Filed: Dec. 23, 1987

[51] Int. Cl.[4] ..... B65H 7/12

[52] U.S. Cl. ..... 250/229; 271/263; 200/332

[58] Field of Search ..... 250/222.1, 223 R, 229, 250/233, 560, 561, 231 SE; 271/3.1, 7, 34, 122, 154, 155, 263; 200/61.41, 61.42, 332

[56] References Cited

U.S. PATENT DOCUMENTS 3,993,303 11/1976 Riedl et al. ..... 271/263
4,078,784 3/1978 Miaskoff et al. ..... 271/263
4,253,654 3/1981 Buys ..... 271/155
4,397,455 8/1983 Hickey ..... 271/155

FOREIGN PATENT DOCUMENTS 1291662 10/1972 United Kingdom .

*Primary Examiner*—David C. Nelms
*Assistant Examiner*—Stephone Allen
*Attorney, Agent, or Firm*—Ronald F. Chapuran

[57] ABSTRACT

A combination electro-optic sensor and switch including a printed wiring board supporting an electro-optic sensor enclosed in a sealed housing, a sleeve mounted on a shaft for rotation within the housing in the light path the electro-optic sensor with a portion of the shaft extending through the sealed housing and connected to a wire actuator, the engagement of the wire actuator by a copy sheet providing an approximately 20 millisecond response time of the sensor.

7 Claims, 4 Drawing Sheets

SEALED MECHANICAL ACTUATOR AND ELECTRO-OPTIC SENSOR FOR USE IN SHEET FEEDING

BACKGROUND OF THE INVENTION

This invention relates to the monitoring of the movement of sheets in a reproduction machine, and in particular, to a combination mechanical actuator and electro-optic sensor to monitor movement of the sheets.

The monitoring of the movement of copy sheets within a reproduction machine has always been a concern to minimize malfunctions and machine down-time. This problem becomes even more acute with the trend of machines toward higher volumes and faster throughputs. The prior art is replete with mechanical switches and sensors to monitor and control the movement of documents and sheets throughout a reproduction machine. In addition, combination electrooptic sensors and mechanical switches are known.

For example U.S. Pat. No. 4,397,455 discloses a stack height sensor including an arm feeler adapted for rotatable movement such that when the height of the stack changes, an arm indicator has a shoulder that blocks an opto-electrical sensor providing an actuating signal to a motor. U.K. Pat. No. 1,291,662 discloses a stack height sensor including a housing, a vertically translatable plunger supported in the housing, an opto-electrical sensor, and an actuator integral with the plunger adapted for movement into the path of the opto-electrical sensor. Xerox Disclosure Journal, Volume 9, No. 4, July/August 1984 discloses a stack height sensor having a housing and a plunger mounted within the housing under pressure from a compression spring such that an actuator is mounted for movement with the plunger for blocking and unblocking an opto-electrical sensor causing the actuation of a motor to raise an elevator and maintain a predetermined normal force of a feed device against a stack of sheets.

Another major concern in reproduction machines has been reliable paper sensing over the product life, particularly with regard to high volume machines. Sensors are very sensitive to degradation over the life of the machine by such things as mechanical wear, dirt, and other debris within the copier environment. Mechanical contact switches in particular are subject to intolerable wear and tear over the life of the machine, requiring replacement or repair and the time and cost of service calls. A difficulty with the prior art copy sheet sensors and switches such as disclosed above is the susceptibility to wear and tear and degradation over the life of the machine. Another need in copy sheet detectors, particularly in high volume machines is the need for relatively fast responding switches and sensors. Rapid switch and sensor response is necessary for proper monitoring control and internal diagnostics of a high volume machine. A difficulty with prior art devices such as described above is that these prior art switches and sensors are relatively complex and massive and unable to provide a rapid switch response.

It is an object of the present invention therefore to provide a new and improved sheet sensor that resists wear and tear, is reliable over the life of the machine, and provides a relatively rapid response to the detection of sheets within the machine. Further advantages of the present invention will become apparent as the following description procedures, and the features characterizing the invention will be pointed out with particularity in the claims annexed to and forming a part of this specification.

SUMMARY OF THE INVENTION

Briefly, the present is a combination electro-optic sensor and switch including a printed wiring board supporting an electro-optic sensor enclosed in a sealed housing, a sleeve mounted on a shaft for rotation within the housing in the light path of the electro-optic sensor with a portion of the shaft extending through the sealed housing and connected to a wire actuator, the engagement of the wire actuator by a copy sheet providing an approximately 20 millisecond response time of the sensor.

For a better understanding of the invention, reference is made to the following drawings wherein the same reference numerals have been applied to like parts and where:

Figure 4:
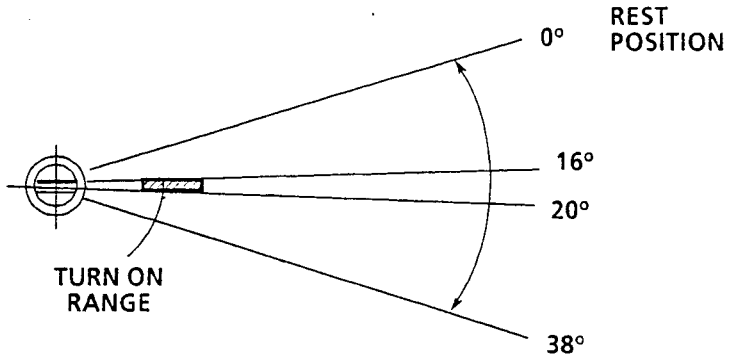

and FIG. 4 illustrates the sleeve travel of the sensor in accordance with the present invention.

DESCRIPTION OF THE INVENTION

Figure 1:
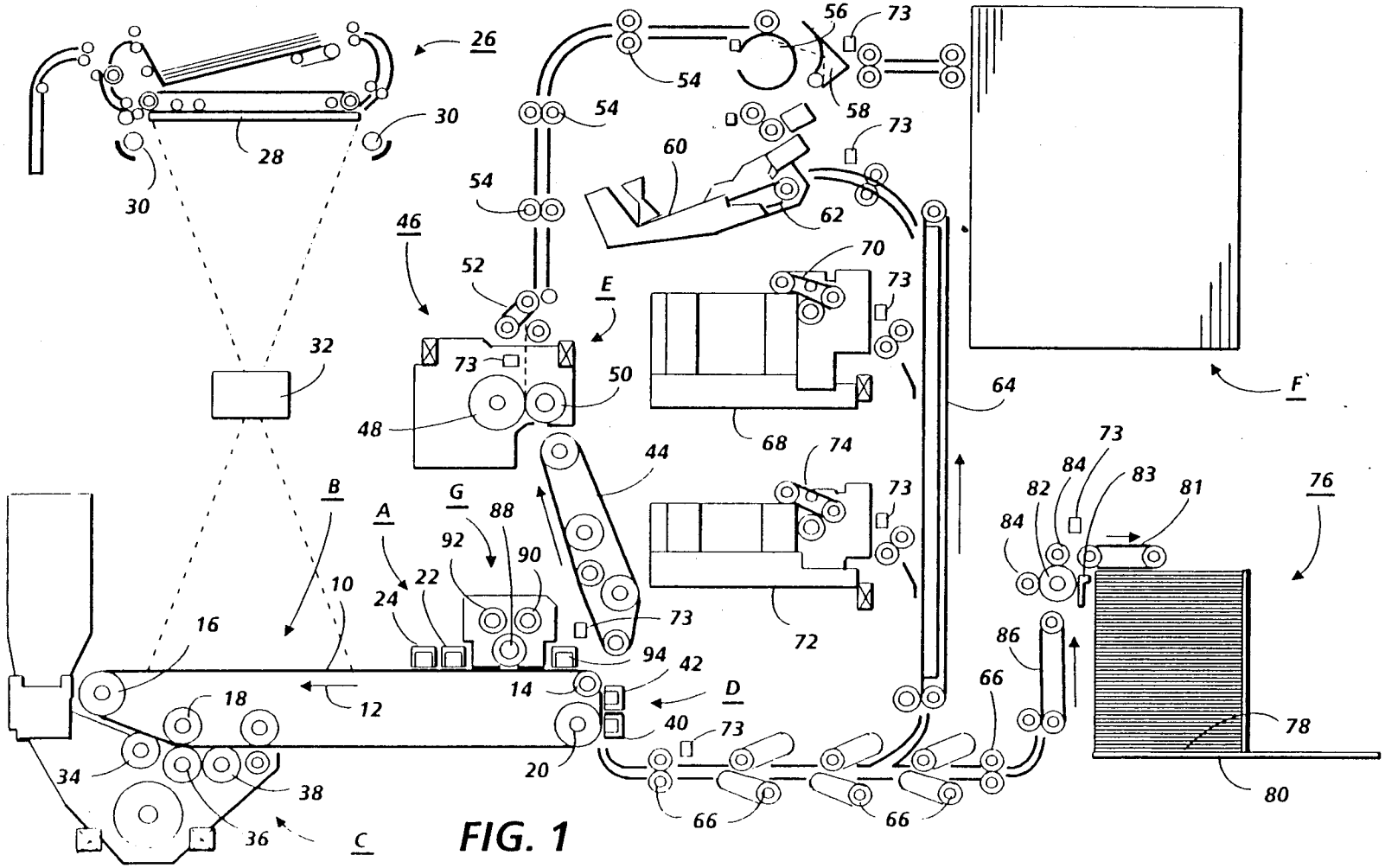
FIG. 1 is an elevational view of a reproduction machine incorporating the features of the present invention.

Referring to FIG. 1 of the drawing, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar. The interface layer aids in the transfer of electrons to the ground layer. The ground layer is very thin and allows light to pass therethrough. Other suitable photoconductive materials, ground layers, and anti-curling backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler roller 18, and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit, indicated generally by the reference numeral 26, is positioned over platen 28 of the printing machine. Documents handling unit 26 sequentially feeds documents from a stack of documents placed by the operator face up on a normal forward collated order in the document stacking and holding tray. A document feeder located below the tray forwards the bottom document in the stack to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the document stack through the feed roll pair. A position gate is provided to divert the document to the inverter or to the feed roll pair. Imaging of a document is achieved by lamps 30 which illuminate the document on platen 28. Light rays reflected from the document are transmitted through lens 32. Lens 32 focuses light images of the original document onto the charged portion of photoconductive belt 10 to selectively dissipate the charge thereon. This records an electrostatic latent image on the photoconductive belt which corresponds to the informational areas contained within the original document. Thereafter, belt 10 advances the electrostatic latent image recorded thereon to development station C.

Development station C has three magnetic brush developer rolls, indicated generally by the reference numerals 34, 36 and 38. A paddle wheel picks up developer material and delivers it to the developer rolls. When developer material reaches rolls 34 and 36, it is magnetically split between the rolls with half the developer material begin delivered to each roll. Photoconductive belt 10 is partially wrapped about rolls 34 and 36 to form extended development zones. Developer roll 38 is a cleanup roll. A magnetic roll, positioned after developer roll 38, in the direction of arrow 12, is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detach the copy sheet from belt 10. Conveyor 44 advances the copy sheet to fusing station E.

Fusing station E includes a fuser assembly, indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfer to a donor roll and then to the fuser roll. Afer fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F or to duplex tray 60. At finishing station F, copy sheets are stacked in a compiler tray and attached to one another to form sets. The sheets are attached to one another by either a binding device or a stapling device. In either case, a plurality of sets of documents are formed in finishing station F. When duplex solenoid gate 58 diverts the sheet into duplex tray 60. Duplex tray 60 provides an intermediate or buffer storage for those sheets that have been printed one one side and on which an image will be subsequently printed on the second, opposed side thereof, i.e. the sheets being duplexed. The sheets are stacked in duplex tray 60 face down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator drive by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance succesive copy sheets to transport 64 which advances the sheets to rolls 66 and then to transfer station D.

Secondary tray 68 and auxiliary tray 72 are secondary sources of copy sheets. A high capacity feeder, indicated generally by the reference numeral 76, is the primary source of copy sheets. High capacity feeder 76 includes a tray 78 supported on an elevator 80. The elevator is driven by a bidirectional AC motor to move the tray up or down. In the up position, the copy sheets are advanced from the tray to transfer station D. A flutter and air knife 83 direct air onto the stack of copy sheets on tray 78 to separate the uppermost sheet form the stack of copy sheets. A vacuum pulls the uppermost sheet against feed belt 81. Feed belt 81 feeds successive uppermost sheets from the stack to a take-away drive roll 82 and idler rolls 84. The drive roll and idler rolls guide the sheet onto transport 86. Transport 86 advances the sheet to rolls 66 which, in turn, move the sheet to transfer station D.

At suitable locations along the copy sheet path, copy sheet sensors 73 are positioned to detect the presence of a copy sheet. For example, sensors 73 are illustrated at registration at the transfer station D, at the exit of the transfer station, at the exit of the fuser rolls 48, 50, at the entry to the finishing station F, and at the exit of the high capacity feeder 76, secondary tray 68, auxiliary tray 72, and duplex tray 60. The presence or absence of a copy sheet indicates timing or jamming information that is monitored by a (not shown) controller.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an elecltrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delay, jam corrections, etc. The control of all of the exemplary systems heretofore described may be accomplished by conventional control switch inputs from the printing machine console selected by the operator. Conventional sheet path sensors or switches may be utilized to keep track of the position of the documents and the copy sheets. In addition, the controller regulates the various positions of the gates depending upon the mode of operation selected.

Figure 2A:
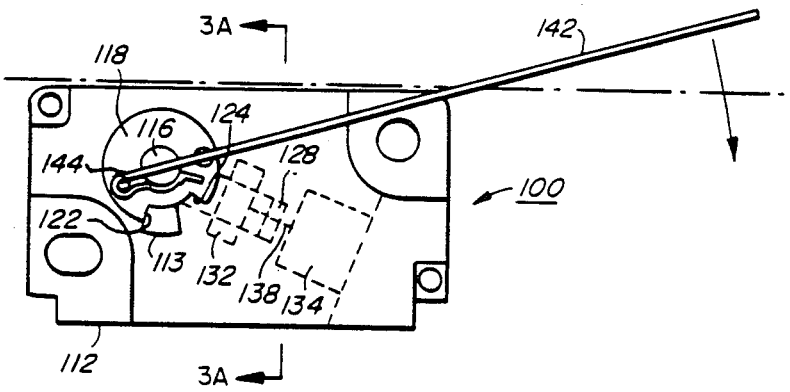
FIGS. 2A and 2B are a side view of the switch in accordance with the present invention.
Figure 2B:
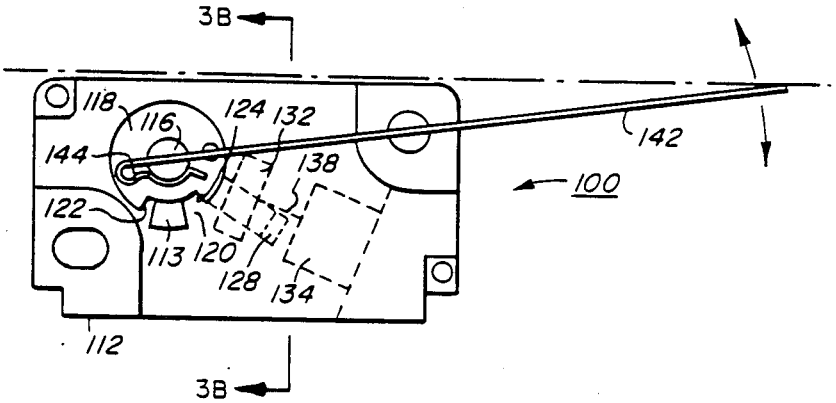

With respect to FIGS. 2A, 2B, 3A and 3B, there is illustrated a mechanical photosensor in accordance with the present invention generally indicated at 100, including a housing 112 of molded plastic or any other suitable material having a projecting nib 113 extending externally from one of the walls of the housing 112. In a preferred embodiment, the housing is sealed to minimize the entry of dirt of other foreign particles within the housing interior. A shaft 114 is journaled for rotation within the interior of the housing and includes a shaft extension 116 extending through a wall of the housing and supporting a disc 118 having a cut away portion 120 defined by sides 122, 124 of the disc 118. The side 122 is spring biased against the projecting nib 113 as shown in FIG. 2A, and as the disk 118 is rotated in a clockwise direction, the motion of the disc is arrested by the engagement of side 124 with the projecting nib 113. Within the housing 112, a follower 126 is rigidly secured to the shaft 114, one leg of the follower 126 being sleeve 128.

Figure 3A:
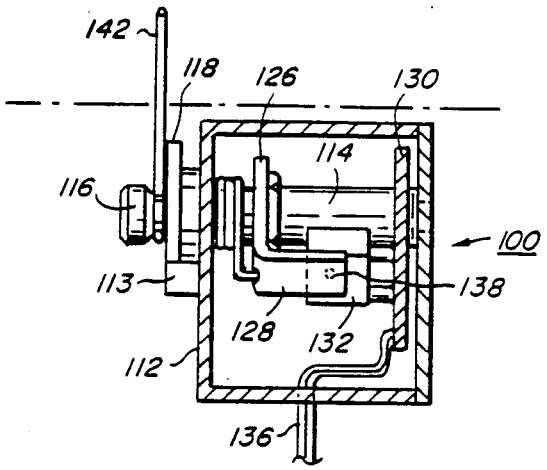
FIGS. 3A and 3B are cross sectional views of the switch of FIGS. 2A and 2B along arrow A—A and B—B.
Figure 3B:
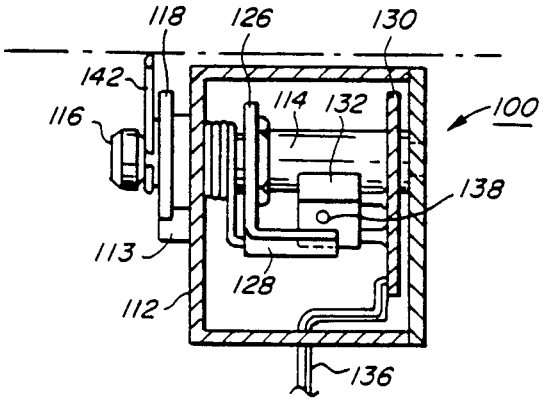

A printed wiring board 130 is fixed within the housing as shown in FIGS. 3A and 3B, and supports light emitting diode (LED) 132 and a photodetector 134 as well as suitable electrical connections 136 for attachment to a (not shown) power supply. A wire actuator 142 is secured to the shaft extension 116 by spring clip 144 and the mechanical photosensor 110 is mounted in the machine as illustrated in FIG. 1 to position the wire actuator 142 in the path of travel of copy sheets within the machine.

In operation, the mechanical photosensor 100 is initially in a rest position as illustrated in FIGS. 2A and 3A and with the side 122 of the disc 118 abutting the projecting nib 113, thus placing the sleeve 128 directly in the light path 138 between the LED 132 and the photodetector 134. Upon engagement of the wire actuator 142 by a copy sheet moving in the direction of the arrow as illustrated in FIG. 2A, the movement of the wire actuator 142 in a clockwise direction will rotate the disc 118 in the clockwise direction. The movement of the disc 118 and the sleeve 128 in the clockwise direction carries the sleeve 128 out of the optical path 138 between the LED 132 and the photodetector 134, thus generating a signal indicating the arrival or presence of a copy sheet. The maximum rotation of the wire actuator 142 is to the point of engagement of the side 124 of the disc 118 with the projecting nib 113.

FIG. 4 illustrates the preferred operating characteristics with respect to the rotation of the wire actuator 142 and movement of the sleeve 128. The rest position as illustrated in FIG. 3 is shown at 0° in FIG. 4. The angle of travel of the sleeve 128 to exit the optical path is approximately at 15±3°, having a turn on range of approximately 4°. The total stroke is dependent on the cut away portion 120 and is illustrated as a minimum of 38° from the rest position and generally includes a minimum overtravel of 15°. In a preferred embodiment the operating torque on the wire actuator 42 is 1.0 N. mm maximum and a return time of the wire actuator to rest position from the maximum stroke angle is 20 milliseconds. With a response time of 20 milliseconds maximum, the mechanical photosensor 100 can be used for copy sheet registration and timing.

While there has been illustrated and described what is, at present, considered to be a preferred embodiment of the present invention, it will appreciated that numerous changes and modifications are likely to occur to those skilled in the art, and it is intended in the appended claims to cover all those changes and modifications which fall within the true spirit and scope of the present invention.

We claim:

1. A switch for monitoring the movement of the sheets comprising:

an enclosed, sealed housing, a printed wiring board disposed within the housing and supporting an electro-optic-sensor, the electrooptic sensor including an LED and a photodetector, a sleeve mounted on a shaft for rotation within the housing in the light path between the LED and the photodetector, a portion of the shaft extending outside the sealed housing, the sleeve being provided with a home position, a mechancial arm disposed outside the sealed housing and mechanically connected to said portion of the shaft whereby engagement of the mechanical arm by a sheet rotates the shaft to move the sleeve in relation to the light path, and a stop secured to the housing defining an end of travel position, the time of return of the sleeve between the home position and the end of travel position being less than 20 milliseconds.

2. In a reproduction machine having apparatus for conveying sheets, a switch for monitoring the movement of the sheets comprising:

a sealed housing, a printed wiring board disposed within the housing and supporting an electro-optic sensor, the electro-optic sensor including a light source and a photodetector, a sleeve mounted on a shaft for rotation within the housing in the light path between the light source and the photodetector, a portion of the shaft extending outside the housing, and a mechanical arm disposed outside the sealed housing and mechanically connected to said portion of the shaft whereby engagement of the mechanical arm by a sheet rotates the shaft to move the sleeve in relation to the light path.

3. The switch of claim 2 wherein the mechanical arm is a spring steel wire actuator.

4. The switch of claim 2 wherein the LED forward current is less than 100 milliamps and the detector power dissipation is less than 100 milliwatts.

5. The switch of claim 2 wherein the maximum operating torque on the mechanical arm is 1.0 N.mm.

6. The switch of claim 2 including a stop secured to the housing defining an end of travel position and wherein the sleeve is provided with a home position, the time of return of the sleeve between the home position and the end of travel position being less than 50 milliseconds.

7. The switch of claim 6 wherein the degree of rotation of the sleeve between the home position and the end of travel position being greater than 30 degrees.

* * * * *